US007445218B2

(12) United States Patent
Esposito et al.

(10) Patent No.: US 7,445,218 B2
(45) Date of Patent: Nov. 4, 2008

(54) SKATEBOARD DECK WITH DECORATIVE WINDOW

(76) Inventors: Marcelo Fabian Esposito, 1135 Bonita Dr., Encinitas, CA (US) 92024; Mark Mitsugi Takahashi, 12487 Cavallo St., San Diego, CA (US) 92130

( * ) Notice: Subject to any disclaimer, the term of this patent is extended or adjusted under 35 U.S.C. 154(b) by 447 days.

(21) Appl. No.: 11/259,411

(22) Filed: Oct. 26, 2005

(65) Prior Publication Data

US 2006/0103098 A1 May 18, 2006

Related U.S. Application Data

(60) Provisional application No. 60/624,725, filed on Nov. 3, 2004.

(51) Int. Cl.
*B62M 1/00* (2006.01)

(52) U.S. Cl. ..... 280/87.042; 280/11.203; 280/11.27; 280/11.28

(58) Field of Classification Search ..... 280/87.042, 280/11.203, 11.27, 11.28
See application file for complete search history.

(56) References Cited

U.S. PATENT DOCUMENTS

| | | | | |
|---|---|---|---|---|
| 4,337,963 | A * | 7/1982 | Stevenson | 280/87.042 |
| 5,029,702 | A * | 7/1991 | Tong | 206/315.1 |
| 5,997,018 | A * | 12/1999 | Lee | 280/87.042 |
| 6,431,733 | B2 * | 8/2002 | Seifert et al. | 362/459 |
| D478,643 | S * | 8/2003 | Langford et al. | D21/765 |
| 6,979,005 | B1 * | 12/2005 | McLerran | 280/33.998 |
| 2003/0155732 | A1 * | 8/2003 | Carbonero | 280/87.01 |
| 2005/0212246 | A1 * | 9/2005 | Hong | 280/87.042 |

* cited by examiner

*Primary Examiner*—Christopher Ellis
*Assistant Examiner*—Jacob Meyer

(57) ABSTRACT

A skateboard deck includes a hole or cavity formed therein, which is filled with a clear, transparent, or translucent filler material that does not significantly alter the structural integrity of the deck. The filler material forms a window or a translucent insert in the deck. In one practical embodiment, an object (or objects) is located within the window or translucent insert. The object may be a decal corresponding to the brand, manufacturer, distributor, or retailer of the skateboard deck, an active electronic component, or any suitable feature, compound, apparatus, device, or material.

12 Claims, 3 Drawing Sheets

SKATEBOARD DECK WITH DECORATIVE WINDOW

RELATED APPLICATIONS

This application claims the benefit of U.S. provisional patent application Ser. No. 60/624,725, filed Nov. 3, 2004.

TECHNICAL FIELD

The present invention relates generally to skateboard equipment. More particularly, the present invention relates to a skateboard deck and related manufacturing techniques.

BACKGROUND

Skateboarding is a wonderful sport that has become more popular with America's youth than little league baseball, Pop Warner football, and other traditional sporting activities. A skateboard includes the following fundamental components: a deck; four wheels; and two trucks that attach the wheels to the deck and which serve as turning mechanisms for the skateboard. The prior art is replete with decks having various shapes, sizes, and constructions (e.g., the industry standard 7-ply wood construction, composite constructions that utilize one or more fiberglass, carbon graphite, or other layers in addition to wood veneers, or the like). Excluding the truck mounting holes that are drilled through the deck, skateboard decks have traditionally been of solid construction.

The popularity of skateboarding has led to an increased competition in the historically low-margin skateboard deck manufacturing and distribution industry. Success in the skateboard deck manufacturing and distribution industry can be dependent upon effective trademark, branding, image-building, and marketing strategies. For example, skateboard equipment manufacturers may offer apparel, decals, and other brand-conscious items in addition to the actual equipment, which may otherwise be perceived as being fungible from brand to brand. In addition, skateboard equipment manufacturers may strive to introduce new product features (functional, aesthetic, or a combination thereof) to distinguish their products from those of their competitors. For example, a distinct deck shape, a unified theme of graphics for a series of decks, a truck with special painted graphics, or wheels having a unique shape or profile may increase market share.

Accordingly, there is a need for a skateboard deck having unique features that are eye-catching and marketable. Furthermore, other desirable features and characteristics of the present invention will become apparent from the subsequent detailed description and the appended claims, taken in conjunction with the accompanying drawings and the foregoing technical field and background.

BRIEF SUMMARY

A skateboard deck according to the invention includes one or more holes or cavities formed therein, and a translucent or transparent filler material located within the holes/cavities. The filler material preserves the structural integrity of the skateboard deck, while providing a decorative "window" that is pleasing to the eye and distinctive. In one preferred embodiment, an insert object is located within the filler material and the insert object is visible from one or both sides of the deck. The insert object may, for example, serve to identify the brand, manufacturer, or distributor of the deck.

The above and other aspects of the invention may be carried out in one form by a skateboard deck comprising a deck, a hole formed within said deck, and a window located within said hole.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
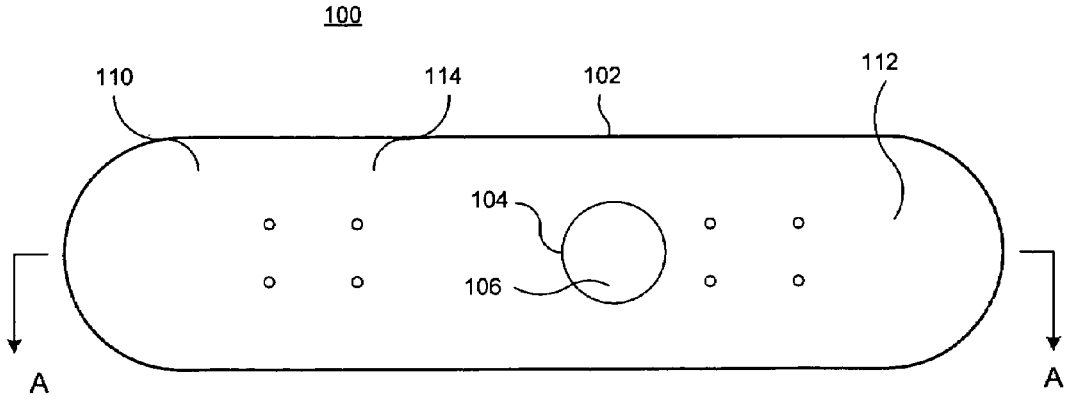
FIG. 1 is a top view of a skateboard deck according to the invention.
Figure 2:
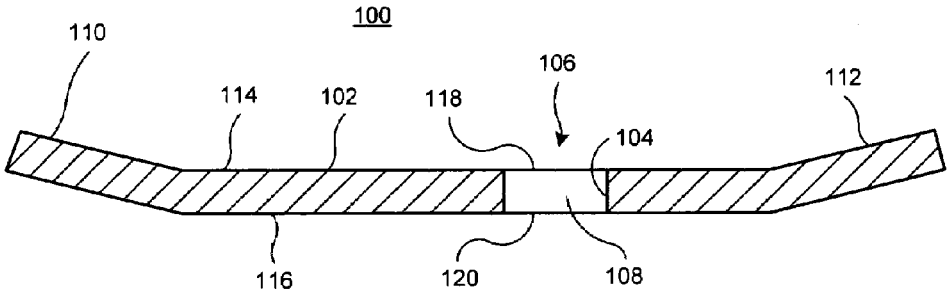
FIG. 2 is a cross sectional view of the skateboard deck shown in FIG. 1, as viewed from line A-A.

FIG. 1 is a top view of a skateboard deck 100 according to the invention, and FIG. 2 is a cross sectional view of skateboard deck 100 as viewed along line A-A. It should be appreciated that the invention described herein may be incorporated into skateboard decks of various constructions, including, without limitation: laminated wood; solid wood; plastic; composite; fiberglass; metal; and any combination thereof. The example embodiments described herein employ the industry standard laminated wood construction, which typically includes six or seven laminated or glued wood veneers. In this regard, skateboard deck 100 may leverage conventional manufacturing techniques known to those skilled in the art and such conventional manufacturing techniques will not be described in detail herein.

Skateboard deck 100 generally includes a deck 102, a hole 104 formed within deck 102, and a window 106 located within hole 104. In the example embodiment, window 104 comprises a translucent or transparent filler material 108. Deck 102 may be variously sized, shaped, and contoured according to its intended use and/or consumer preferences. Hole 104 spans the entire thickness of deck 102, i.e., hole 104 penetrates all the way through deck 102. Hole 104 may be of any desired shape and size, depending upon the specific application, and the circular hole 104 shown in FIG. 1 is merely one of many practical possibilities. For example, the hole may be shaped to resemble a company logo, image, or theme. In this regard, one skateboard truck manufacturer is very well known for its shield-like logo. It may be desirable for this manufacturer to produce a skateboard deck having a hole or cavity that is shaped like their logo. The use of such a decorative window would bolster the brand recognition due to its immediate storefront visibility, and visibility in magazine photographs.

It should be noted that hole 104 need not be vertically aligned relative to the thickness of deck 102 (as depicted in FIG. 2), and hole 104 may have angled or tapered edges that cut across the thickness of deck 102. Furthermore, the position of hole 104 within deck 102 may vary in practice and the specific location shown in FIG. 1 and FIG. 2 is not intended to limit the invention in any way. Indeed, hole 104 may be located in the nose 110 of deck 102, in the tail 112 of deck 102, or elsewhere in deck 102. Furthermore, although only one hole 104 is shown in FIG. 1, deck 102 may include any number of holes and/or cavities. In the preferred embodiment, hole 104 is sized and shaped such that it has little, if any, impact on the structural integrity of skateboard deck 100.

In one embodiment, window 106 is transparent and clear, and it contains no embedded or inserted objects. In other words, window 106 is unobstructed and provides a viewing path through deck 102. In alternate embodiments, window 106 may be colored and transparent, colored and translucent, colored and opaque, uncolored and translucent, uncolored and opaque, and with or without embedded or inserted objects. Skateboard deck 100 shown in FIG. 1 and FIG. 2 includes an unobstructed window 106 formed from filler material 108 having no objects embedded or inserted therein. Deck 102 has a top surface 114 and a bottom surface 116, and window 106 has a top surface 118 and a bottom surface 120. In the preferred embodiment, top surface 114 of deck 102 corresponds to top surface 118 of window 106, and bottom surface 116 of deck 102 corresponds to bottom surface 120 of window 106. In other words, top surface 114 is continuous with top surface 118 and bottom surface 116 is continuous with bottom surface 120. This feature is desirable to maintain the traditional top and bottom surfaces of skateboard deck 100, which may be important for proper foot placement, board feel, and to accommodate tricks that require board sliding.

Filler material 108 may be realized in any number of practical forms. For example, filler material 108 may be realized as a solid puck shaped item or insert that is secured within hole 106. In the preferred embodiment, however, filler material 108 is formed from a suitable material that is liquid, molten, or pliable in its uncured state and solid in its cured state. For example, in practical embodiments, filler material 108 may be formed from a suitable epoxy, resin, plastic, plexiglass, or other compound that can be poured or dispensed into hole 104 then cured into a solid to form window 106. Such compounds are commercially available and the above list of suitable materials is not intended to be exhaustive. The use of an uncured liquid filler material ensures that window 106 completely fills hole 104 after curing. Such complete filling may be desirable for aesthetic reasons and to enhance the structural integrity of skateboard deck 100.

Figure 3:
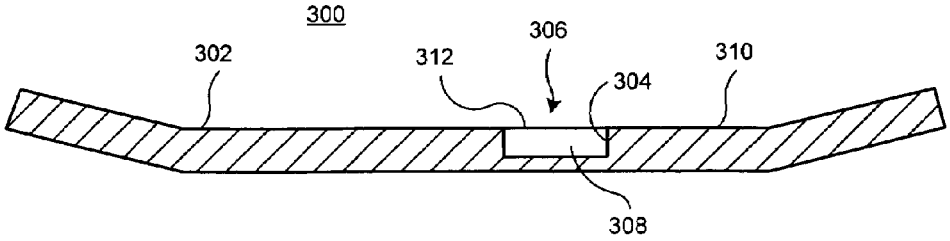
FIG. 3 is a cross sectional view of a skateboard deck according to an alternate embodiment of the invention.

FIG. 3 is a cross sectional view of a skateboard deck 300 according to an alternate embodiment of the invention. Features of skateboard deck 300 that are common to skateboard deck 100 will not be described in detail. Skateboard deck 300 generally includes a deck 302, a cavity 304 formed within deck 302, and a translucent or transparent insert 306 located within cavity 304. Briefly, skateboard deck 300 is similar to skateboard deck 200, however, skateboard deck 300 employs cavity 304 (rather than hole 104), which does not penetrate the entire thickness of deck 302.

Cavity 304 may be of any desired shape and size, depending upon the specific application, and size and shape of cavity 304 shown in FIG. 3 is merely one of many practical examples. In addition, cavity 104 need not be vertically aligned relative to the thickness of deck 302 (as depicted in FIG. 3), and cavity 304 may have angled or tapered edges that cut across the thickness of deck 302. Furthermore, the position of cavity 304 within deck 302 may vary in practice and the specific location shown in FIG. 3 is not intended to limit the invention in any way. Furthermore, although only one cavity 304 is shown in FIG. 3, deck 302 may include any number of holes and/or cavities. In the preferred embodiment, cavity 304 is sized and shaped such that it has little, if any, impact on the structural integrity of skateboard deck 100.

In one embodiment, insert 306 is transparent, clear, and contains no embedded or inserted objects. In other words, insert 306 is clear and unobstructed. In alternate embodiments, insert 306 may be colored and transparent, colored and translucent, colored and opaque, uncolored and translucent, uncolored and opaque, and with or without embedded or inserted objects. Skateboard deck 300 shown in FIG. 3 includes an unobstructed insert 306 formed from filler material 308 having no objects embedded or inserted therein. Deck 302 has a top surface 310, and insert 306 has a top surface 312. In the preferred embodiment, top surface 310 of deck 302 corresponds to top surface 312 of insert 306. In other words, top surface 310 is continuous with top surface 312. This feature is desirable to maintain the traditional top surface of skateboard deck 300, which may be important for proper foot placement, board feel, and to accommodate tricks that require board sliding. Of course, cavity 304 and insert 306 may instead be formed on the bottom surface of deck 302, and the respective bottom surfaces can be continuous as described above.

Filler material 308 may be configured, formed, and realized as described above in connection with filler material 108. In practice, the use of an uncured liquid filler material ensures that insert 306 completely fills cavity 304 after curing. Such complete filling may be desirable for aesthetic reasons and to enhance the structural integrity of skateboard deck 300.

Figure 4:
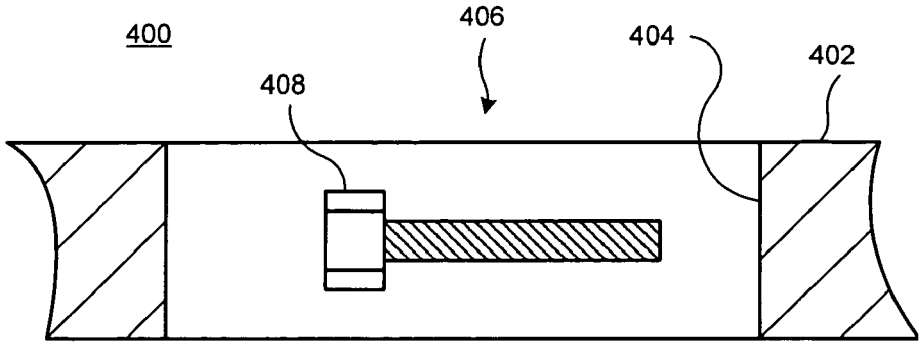
FIGS. 4-6 are cross sectional views of portions of skateboard decks according to various embodiments of the invention.

In accordance with one preferred aspect of the invention, the skateboard deck includes an insert object located within the window and/or insert in the deck. The insert object (or objects) may be any suitable part, component, element, or substance, depending upon the intended design and/or marketing objectives. For example, the insert object may be a decal, patch, photograph, or artwork, such as an item that identifies the brand, manufacturer, or distributor of the skateboard deck. As another example, the insert object (or objects) may be a decorative substance such as glitter, ink, dye, colored particles, glow in the dark particles, reflective particles, or the like. As another example, the insert object may be a coin, jewelry, a shark's tooth, a shell, a bone, or other object, such as an item intended to represent a company logo, image, or theme. In this regard, one skateboard equipment manufacturer is very well known for its skateboard truck hardware, i.e., the nuts and bolts that secure the trucks to the deck. It may be desirable for this manufacturer to produce a skateboard deck as shown in FIG. 4, which is a cross sectional view of a portion of a skateboard deck 400. Skateboard deck 400 includes a deck 402, a hole 404 formed within deck 402, and a window 406 located within hole 404. Notably, skateboard deck 400 also includes an insert object 408 (in this example, a skateboard truck bolt, which serves as a brand identifier and a marketing tool for the above-mentioned equipment manufacturer) located within window 406. Embedding insert object 408 into window 406 creates a "floating" effect within window 406. If a transparent filler material is utilized to form window 406, insert object 408 will be visible from both sides of deck 402.

Figure 5:
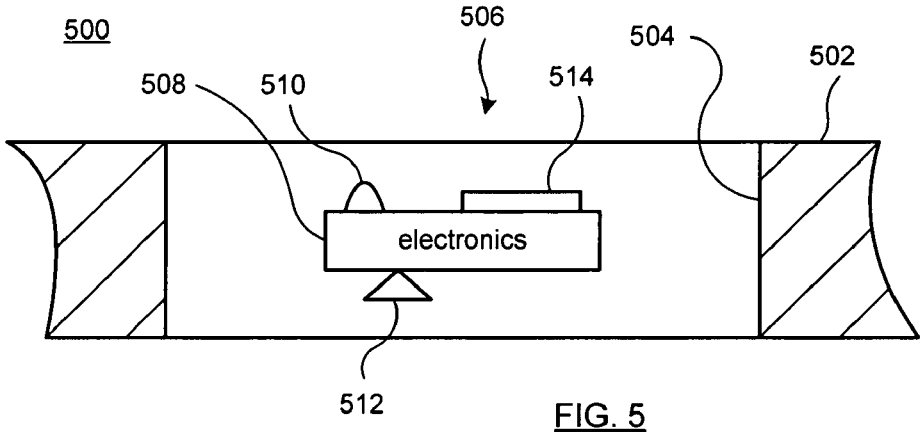

The insert object located within the window and/or insert in the deck may be an active electronic component. In this regard, FIG. 5 is a cross sectional view of a portion of a skateboard deck 500. Skateboard deck 500 includes a deck 502, a hole 504 formed within deck 502, and a window 506 located within hole 504. Notably, skateboard deck 500 also includes an insert object 508 (in this example, an active electronics package) located within window 506. The active electronics may include a self-contained power supply such as a battery for providing power to, for example, LED lights 510, an audio transducer 512, and/or a video display 514. Considering the relatively short lifespan of a skateboard deck, a long life battery and low power electronics may provide enhanced consumer appeal for the life of the deck. The active electronics may be utilized to attract potential buyers, to further enhance the branding strategy of the deck manufacturer, distributor, or retailer, or to provide entertainment to the user of the deck. For example, the active electronics may be programmed with songs, short skateboarding video clips, advertisements, dynamically activated sound bites or lighting effects, or the like.

Figure 6:
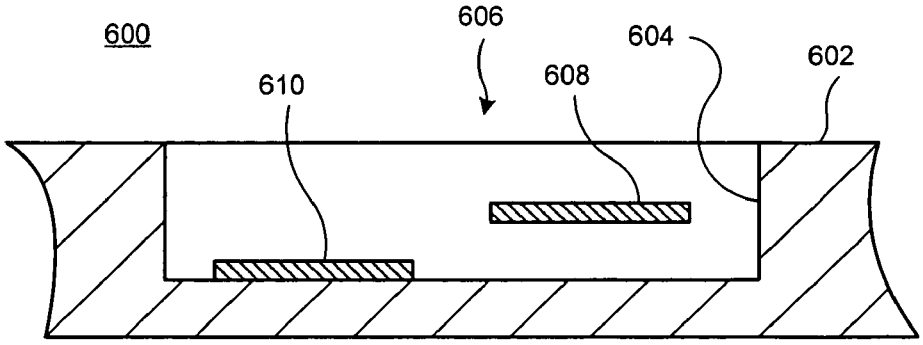

FIG. 6 is a cross sectional view of a portion of a skateboard deck 600 according to yet another embodiment of the invention. Skateboard deck 600 includes a deck 602, a cavity 604 formed within deck 602, and an insert 606 located within cavity 604. Notably, skateboard deck 600 may also include an insert object 608 embedded within insert 606 and/or an insert object 610 covered by insert 606. Embedding insert object 608 into the filler material creates a "floating" effect within the cavity 604. On the other hand, insert object 610 may be placed at (or affixed to) the bottom of cavity 604 before the filler material is deposited within cavity 604. Of course, the insert objects shown in FIG. 6 may be any of the active electronic, passive articles, substances, devices, or components described above.

Skateboard decks typically include a graphic design (i.e., "graphics") on the bottom surface and/or on the top surface. Such graphics may be painted onto the deck, etched into the deck, applied as a transfer or decal onto the deck, or the like. In accordance with one practical embodiment of the invention, the size, shape, and location of window 106 (see FIG. 1), insert 306 (see FIG. 3), or any of the windows/inserts described herein, may be designed in accordance with the graphics on the deck. For example, a skateboard deck having a snake graphic may include two small round windows that represent the eyes of the snake. For added appeal, the eye windows may be tinted or colored a suitable color, such as red or green. As another example, a skateboard deck having a flame graphic may include any number of windows that match the outline of the flames, and the flame windows may be tinted or colored red, yellow, or orange to resemble fire. Moreover, contextually relevant insert objects for the windows/inserts in the skateboard deck can be chosen to enhance the graphics of the skateboard deck. For example, a skateboard deck having a Japanese themed graphic may include a window or insert having Japanese flowers or Japanese artifacts embedded therein. As another example, a skateboard deck having a computer themed graphic may include a window or insert having electronic chips, electronic components, or wires embedded therein.

Figure 7:
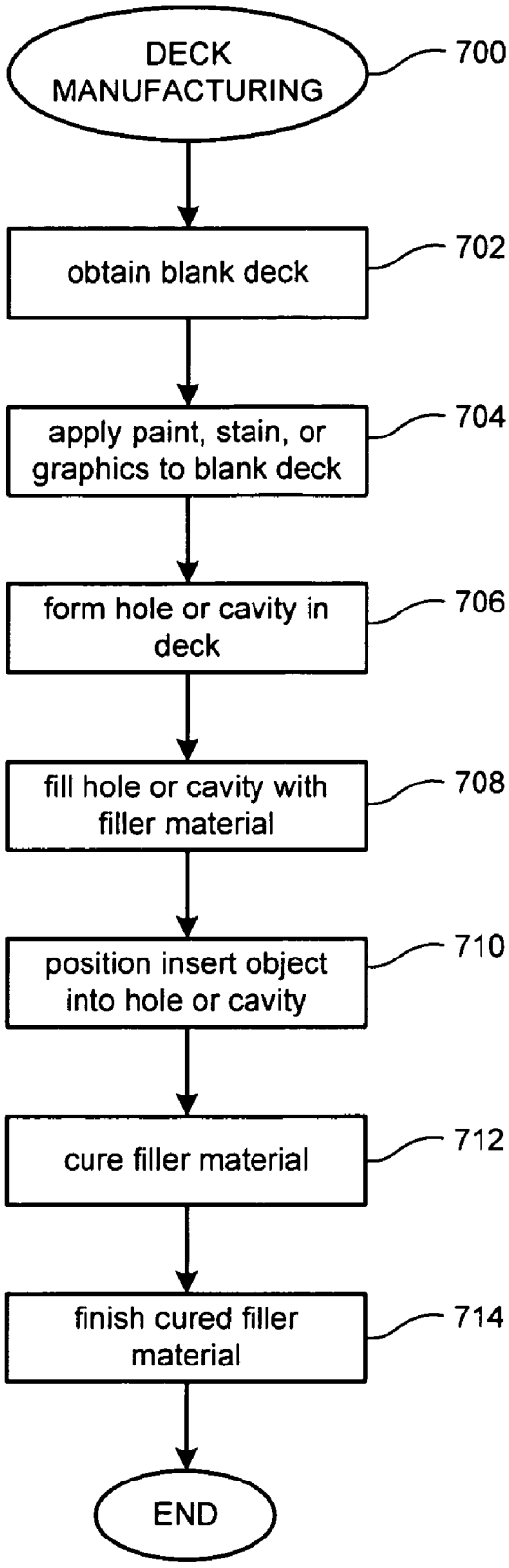
FIG. 7 is a flow chart of a skateboard deck manufacturing process according to the invention.

FIG. 7 is a flow chart of a skateboard deck manufacturing process 700 according to the invention. The various tasks performed in connection with process 700 may be performed by hand, with the assistance of conventional manufacturing tools and equipment, by various automated manufacturing equipment, with the assistance of computer processes, by software, hardware, firmware, or any combination thereof. It should be appreciated that process 700 may include any number of additional or alternative tasks, the tasks shown in FIG. 7 need not be performed in the illustrated order, and process 700 may be incorporated into a more comprehensive skateboard deck manufacturing process or technique having additional tasks not described in detail herein.

Deck manufacturing process 700 may begin by obtaining a blank deck (task 702), which may be cut and shaped, or uncut. Blank deck creation may leverage existing technologies and such technologies are generally well known. Indeed, process 700 may simply obtain blank decks (or even painted or stained decks) from a third party manufacturer. If necessary, process 700 applies paint, stain, and/or graphics to the blank deck (task 704). Again, decks that are already painted, silk screened, stained, or otherwise treated may be obtained from a third party. In fact, process 700 can begin with skateboard decks that are otherwise ready for resale to consumers and the invention described herein may represent a modification to existing skateboard decks.

Deck manufacturing process 700 eventually forms at least one hole and/or at least one cavity in the deck (task 706). It should be appreciated that "hole" generally refers to any cutout shape that extends all the way through the deck, and that "cavity" generally refers to any depression that does not extend all the way through the deck. Cavities may be formed using any number of known techniques, e.g., milling, routing, CNC machining, woodcutting, filing, laser etching, planing, sanding, grinding, or the like. Holes may be formed using any number of known techniques, e.g., drilling, hole cutting, sawing, laser cutting, chipping, or the like. As mentioned above, task 706 is preferably performed in a manner that does not significantly impact the structural integrity of the skateboard deck. In some embodiments, the hole or cavity (or any number of holes or cavities) are formed in a manner that matches, enhances, or complements the paint, stain, and/or graphics on the deck. In other words, the holes or cavities may be specifically sized, shaped, and located in accordance with the graphics.

Next, the holes and/or cavities are filled with a suitable filler material, e.g., clear resin (task 708). If the skateboard deck will not include any inserted objects, features, or substances, then the filler material is deposited into the holes and/or cavities in an appropriate manner. In one practical embodiment, a clear resin epoxy is deposited into the hole/cavity while it is in an uncured and liquid state. A plate, cover, or tape may be utilized to form a protective shell at one surface of the deck, thus preventing spillage of the filler material during application and ensuring that, when cured, the contour and surface of the filler material resembles that of the surrounding deck. If desired, a suitable insert object or objects may be positioned into the hole/cavity before, during, or after application of the filler material (task 710). For example, an insert object may be placed at the bottom of a cavity and the filler material may be dispensed into the cavity to cover the insert object. Alternatively, a base amount of the filler material may be deposited into the hole/cavity and left to cure or partially cure before the insert object is positioned. Thereafter, more filler material can be dispensed to cover the insert object. In accordance with another technique, the insert object may be forced into the filler material after the hole/cavity has been filled.

After the filler material has been applied, a plate, cover, or tape may be utilized to form a protective shell at the surface of the deck, thus preventing spillage of the filler material after application and ensuring that, when cured, the contour and surface of the filler material resembles that of the surrounding deck. Thereafter, the filler material is cured (task 712), with or without outside assistance. If necessary, heat or radiation may be applied to expedite the curing process or to otherwise ensure that the filler material cures in an appropriate manner. After curing, the protective covers or tape (if used) can be removed and the filler material can be finished (task 714) if necessary. During task 714, the exposed surfaces of the filler material may be sanded, ground, buffed, etched, polished, or otherwise treated as desired.

While at least one exemplary embodiment has been presented in the foregoing detailed description, it should be appreciated that a vast number of variations exist. In particular, the specific insert objects described above are not intended to limit the invention and are not exhaustive of the possible insert objects that can be employed in a practical embodiment. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A skateboard deck comprising:

a deck;

a hole fanned within said deck; and a window located within said hole, said window comprising a filler material.

2. A skateboard deck according to claim 1, wherein said window comprises a translucent filler material.

3. A skateboard deck according to claim 1, wherein said window comprises a transparent filler material.

4. A skateboard deck according to claim 1, wherein said window completely fills said hole.

5. A skateboard deck comprising:

a deck;

a hole formed within said deck; and a window located within said hole; wherein said deck has a top surface and a bottom surface;

said window has a top surface that is continuous with said top surface of said deck; and said window has a bottom surface that is continuous with said bottom surface of said deck.

6. A skateboard deck comprising:

a deck;

a hole formed within said deck;

a window located within said hole; and an insert object located within said window.

7. A skateboard deck according to claim 6, wherein said insert object comprises an active electronic component.

8. A skateboard deck according to claim 1, wherein:

said deck includes a graphic design applied thereto; and said window is shaped, sized, and located in accordance with said graphic design.

9. A skateboard comprising:

a deck comprising an upper surface and a lower surface, and further comprising graphics on at least one of the upper surface and the lower surface; and a window formed in the deck, the window being shaped in accordance with the graphics, wherein the window is colored to match the graphics.

10. The skateboard of claim 9, wherein the window comprises a filler material that is liquid in an uncured state and solid in a cured state.

11. The skateboard of claim 9, further comprising an insert object embedded within the window, the insert object being contextually relevant to the graphics.

12. The skateboard of claim 9, wherein:

the window has a top surface that is continuous with the upper surface of the deck; and the window has a bottom surface that is continuous with the lower surface of the deck.

* * * * *

UNITED STATES PATENT AND TRADEMARK OFFICE

CERTIFICATE OF CORRECTION

PATENT NO. : 7,445,218 B2
APPLICATION NO. : 11/259411
DATED : November 4, 2008
INVENTOR(S) : Esposito et al.

It is certified that error appears in the above-identified patent and that said Letters Patent is hereby corrected as shown below:

Column 7, Line 25, in Claim 1, the word “fanned” should read --formed--.

Signed and Sealed this

Sixth Day of January, 2009

JON W. DUDAS
*Director of the United States Patent and Trademark Office*